US005161345A

United States Patent [19]

Sobjack, Sr.

[11] Patent Number: 5,161,345

[45] Date of Patent: Nov. 10, 1992

[54] METHOD AND APPARATUS FOR SUPPORTING AND ERECTING TRUSSES AND OTHER BUILDING FRAME ASSEMBLIES

[76] Inventor: Ernest J. Sobjack, Sr., 125 Sanborn, Big Rapids, Mich. 49307

[21] Appl. No.: 621,354

[22] Filed: Dec. 3, 1990

[51] Int. Cl.[5] ..... E04H 12/20

[52] U.S. Cl. ..... 52/652; 52/650; 52/651; 52/690; 33/668; 33/669; 33/613

[58] Field of Search ..... 52/693, 696, 650, 651, 52/652; 33/668, 669, 613

[56] References Cited

U.S. PATENT DOCUMENTS 3,332,196 6/1967 Tuttle .
4,040,232 8/1977 Snow et al. .
4,322,064 3/1982 Jarvis .
4,942,670 7/1990 Brandt ..... 33/494

*Primary Examiner*—David A. Scherbel
*Assistant Examiner*—Matthew E. Leno
*Attorney, Agent, or Firm*—Price, Heneveld, Cooper, DeWitt & Litton

[57] ABSTRACT

An apparatus and method for securing building construction members such as roof trusses and floor joists. A flat lacer coil fastened between gable trusses and is of sufficient tensile strength to temporarily sustain lateral tipping forces of support trusses as they are fastened to the frame of a building structure. In an alternative embodiment, the lacer coil extends between floor frame members and, when attached to floor joists, counteracts the inherent bowing when they are secured to the floor.

24 Claims, 3 Drawing Sheets

METHOD AND APPARATUS FOR SUPPORTING AND ERECTING TRUSSES AND OTHER BUILDING FRAME ASSEMBLIES

BACKGROUND OF THE INVENTION

This invention relates generally to the method and apparatus for supporting roof trusses, floor joists and other building frame assemblies during building construction.

During the process of building a wood structure such as apartment buildings or single family homes, it is first necessary to construct the walls of appropriate dimensions after which prefabricated roof trusses are either brought to the construction site or are built on the premises. Roof trusses are used and are needed to support the sheathing of the roof and to provide structural integrity. Roof sheathing takes the form of sized sheets of plywood or other material which are nailed to the trusses to form the roofing surface to which shingles, rain gutters and other devices are attached. The weight of this roofing surface requires a supporting structure which is the primary function of the support trusses.

The number of stacked trusses needed to safely support the roof sheathing is generally that number which will fit within the structures' length with a standard separation of 24 inches, more or less. For example, a typical single family home might be 40 feet (480 inches) in length. If trusses are to be separated by 24 inches, a total of 20 trusses would be required. This would include the end gable trusses provided at each end of the structure in addition to those in between. This would mean a total of 18 support trusses are positioned atop the wall frame.

After the end gable trusses are mounted in upright position, the other trusses are generally placed in an upright position against one of the end gable trusses or laid down between the wall frames at a position near one of the end trusses. The first intermediate truss on top of the stack is moved into position 24 inches from the other end gable truss. The lower portion of the intermediate truss is then attached to the wall frame and a carpenter standing within the structure is then handed a 1"×3" board from an assistant on the ground. The carpenter measures and marks the 1"×3" board at 24 inch centers and nails the board at the marked points on the upper portions of the front gable truss and the intermediate truss to hold it in place at this 24" spacing. This process is repeated, moving 24 inches from each preceding truss, until the other gable truss is reached at the other end of the structure. This prior technique is clearly shown in Allen U.S. Pat. No. 3,959,945 where wood spacers separate each support truss.

When all support trusses are in their respective positions, the roof sheathing is ready to be attached over and between the tops of the end gable trusses and intermediate trusses. As the sheathing is laid over and nailed to the trusses, a point is reached at which the 1"×3" support boards must be removed to enable the sheathing to be nailed to the trusses flush with those sheathing sections that already have been nailed down. This process requires much time and effort to remove the 1"×3" boards which also are usually damaged during removal to the point they must be discarded. In addition to time required, the damaged 1"×3" boards are quite expensive. After the support boards are removed, the sheathing itself supplies the needed structural support for each of the support trusses on top of the frame.

SUMMARY OF THE INVENTION

It is the object of the invention to provide a method and apparatus for supporting the roof and trusses of a structure before nailing the sheathing by the use of a coil of strap material (herein referred to as "lacer strap" or "strap"). The strap material provides a means of easily supporting the support trusses without the need to attach 1"×3" support boards which must be removed. It is a further object to provide a support apparatus and method for preventing whip by counteracting compressive forces in floor joists and other construction members. The strap material of the present invention provided in the form of a coil is more easily and safely installed, lightweight and economical since support boards are no longer needed and the use of the same, as compared to boards, is less time consuming.

The apparatus in accordance with the first aspect of the invention includes a flat, coiled, flexible strap which includes markers either in the form of holes, dimpled indentations or other markings located at spaced positions along the length of the strap. Construction nails are inserted at the markers which are spaced at predetermined intervals, typically 24 inches. If holes are used as markers, each hole may include a plastic or metal grommet. The coiled, flexible strap, herein referred to as the "lacer strap", is made of a material of sufficient tensile strength to temporarily support the tipping forces provided by the weight of the trusses.

According to another aspect of the invention, after the end gable trusses are erected on the ends of the wall frame structure, the end of lacer strap is first attached to one of the end gable trusses and is unrolled from the coil parallel to the side walls of the structure and is attached to the other end gable truss. Then at each marked fastening point along the strap, a truss is moved in position and attached to the lacer strap to hold each truss in an upright position. No support boards are then needed to hold the truss. In view of the strap's flat surface, the sheathing for the roof can be nailed directly over the lacer strap without its removal thereby saving much time and expense.

According to yet another aspect of the invention, the lacer strap is extended perpendicular to the support members or joists used in the floor of a structure with the lacer strap attached to each end of the frame floor sections on the outside perimeter of the floor itself. The lacer strap is then attached to the joists at each predetermined attachment point. When a lacer strap is used in this manner, it prevents the joists from whipping or bowing which is inherent when a force is applied to the joist at one or both of its ends.

These and other objects, advantages and features of this invention will become apparent upon review of the following specification in conjunction with the drawings.

DETAILED DESCRIPTION OF THE PREFERRED EMBODIMENT

Figure 1:
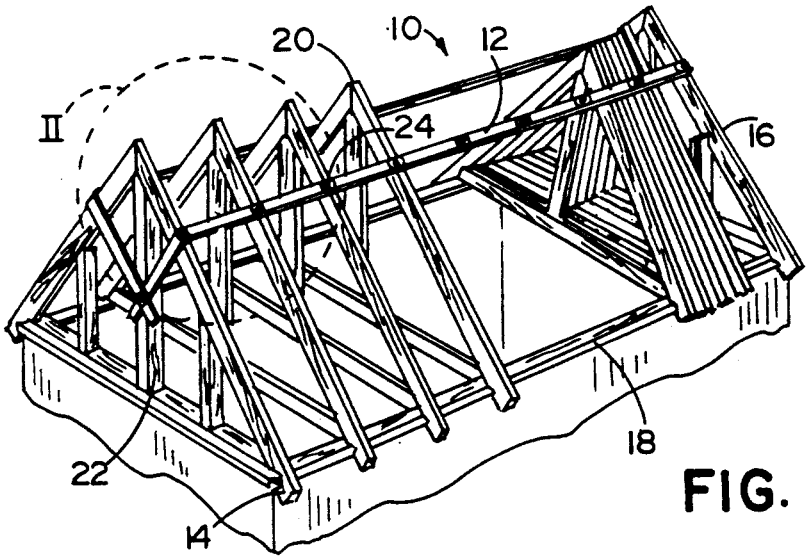
FIG. 1 is a top, perspective view of a structure with lacer straps attached to both sides of each gable truss member.
Figure 2:
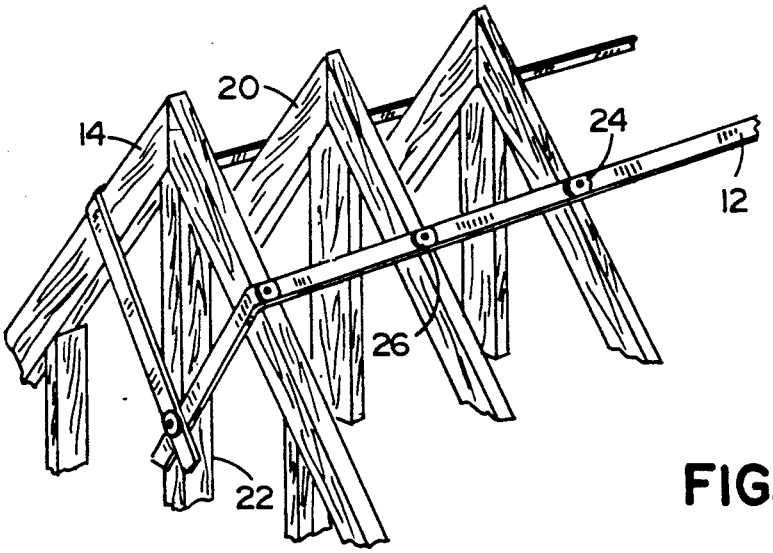
FIG. 2 is a top, perspective view of the lacer strap at its respective attachment point on the truss member.
Figure 10:
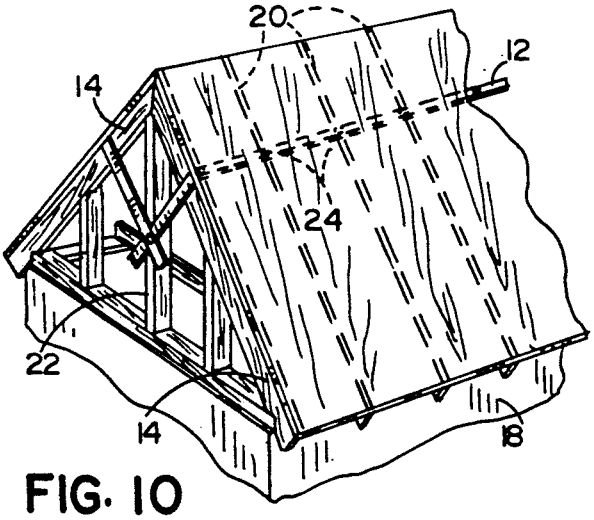
FIG. 10 is a perspective, partial view of a roof structure disclosing trusses with sheathing attached thereto.

Referring now specifically to the drawings and illustrative embodiments depicted therein, FIGS. 1, 2 and 10 disclose a building structure generally identified at 10. The structure 10 includes a wall support frame 18 supported by walls constructed on the ground surface (not shown) which in turn support a front end gable truss 14 and rear end gable truss 16 attached directly to the edges of support frame 18. During a typical building construction, prefabricated support trusses 20 or trusses constructed on the site are either lying stacked one on the other on the frame or as disclosed are in an upright, stacked position leaning against the rear gable truss 16 as depicted in FIG. 1. At the proper time, each support truss 20 is moved to a position generally 24 inches from the preceding support truss 20. In view of the weight of each support truss 20 and other forces such as wind, a tipping force is produced on the truss itself, particularly if it is not exactly balanced on top of support frame 18. The tipping force is worsened on a windy day in that substantial forces are exerted by the wind on the faces of the support trusses 20. Such forces can exceed several hundred pounds.

Figure 3:
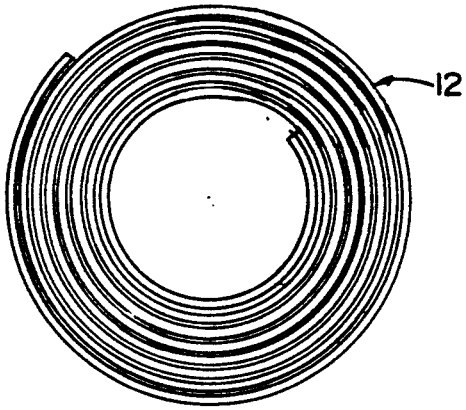
FIG. 3 is a top, plan view of a roll or coil of lacer strap.
Figure 4:
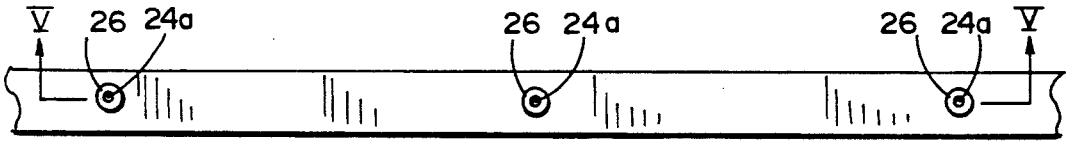
FIG. 4 is a top, plan view of the lacer strap with grommeted hole attachment points.
Figure 5:
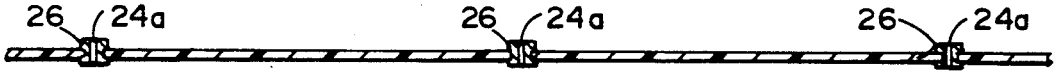
FIG. 5 is a cross sectional view taken along plane V—V of FIG. 4.
Figure 6:
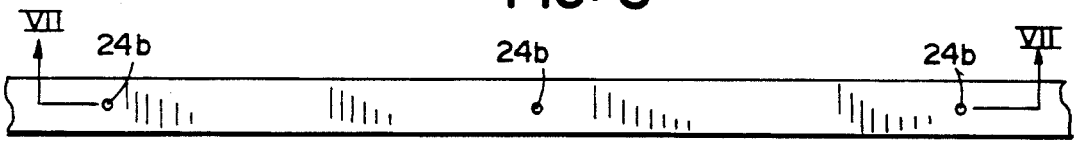
FIG. 6 is a top, plan view of the lacer strap with dimpled attachment points.
Figure 7:
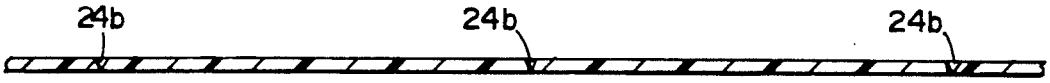
FIG. 7 is a cross-sectional view taken along plane VII—VII of FIG. 6.
Figure 8:
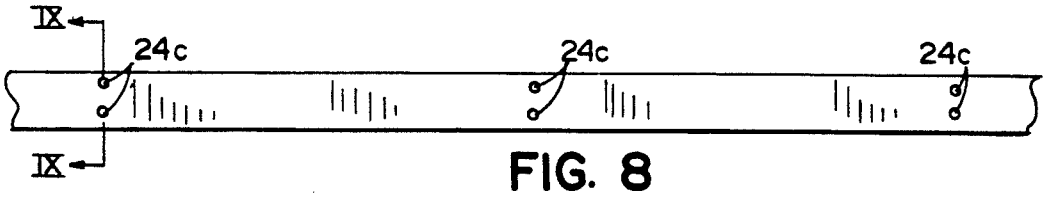
FIG. 8 is a top, plan view of the lacer strap with marker points indelibly marked on the strap.
Figure 9:
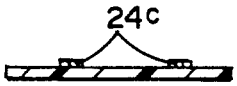
FIG. 9 is a cross-sectional view taken along the plane IX—IX of FIG. 8.

In order to support each support truss 20, a lacer strap 12 is used. Lacer strap 12 is a flexible, flat strap preferably having a width of 0.5 to 1.25 inches and a thickness of 0.03 to 0.06 inches, depending on the material used, the size of the trusses and the anticipated tipping force of the trusses. An example of such material is a plastic, polyester cord strapping manufactured by Cyklop Strapping Corporation of Downingtown, Pa. under the trademark AVISTRAP ®. It is typically 0.75 to 1.25 inches wide and 0.06 to 0.10 inches thick with a tensile strength of 850 to 2500 lbs. and a 0.5% to 1% stretch. Lacer strap 12 is preferably rolled into a coil as shown in FIG. 3 in 50 foot lengths. It includes attachment points collectively herein designated by reference numeral 24 which may be in the form of a precut hole 24*a* (FIGS. 4 and 5), a dimpled indentation 24*b* (FIGS. 6 and 7) or markings 24*c* (FIGS. 8 and 9). When a hole is used as an attachment point, a grommet 26 may be provided to prevent tearing of the material when a construction nail is inserted and a force placed on the lacer strap. Attachment points 24 are typically placed at 24 inch intervals but may be spaced at any predetermined position depending on construction requirements. FIGS. 5 and 7 show cross-sectional representations of each attachment point 24*a* and 24*b* as shown in FIGS. 4 and 6, respectively.

As depicted in FIGS. 1 and 2, before support trusses 20 are brought into their respective positions, either one or two lacer straps 12 are first attached to front end gable truss 14 at an attachment point 24 located at an end of the lacer strap. In order to provide better support for each support truss 20, it is preferable the strap be attached to the midsection or higher of center member 22 of the front end gable 14 so that the support trusses 20 may be brought to the erect position and then more easily balanced while straps 12 are attached thereto.

After the laser strap or straps 12 are attached to front gable truss 14, the strap coil is unrolled to span the distance between front and rear gable trusses 14 and 16 and then it is tightly drawn between the two trusses and attached to the upright center member of rear end gable truss 16 so that the strap is taut. It is important in the example disclosed that the strap, as disclosed in FIGS. 1 and 2, extend in a direction perpendicular to the plane of end gable trusses 14 and 16 so that the other trusses are properly spaced. It should be understood the trusses may be constructed differently than that disclosed, in which event the strap 12 can be attached to different members than a center member so long as the strap extends between and perpendicular to the two end gable trusses in substantially the same position as that shown. When lacer strap or straps 12 are in a taut position between the front gable truss 14 and rear gable truss 16, attachment points 24 will typically be spaced 24 inches apart where each support truss 20 is to be attached. A first support truss 20 is then removed from the stack and positioned 24 inches from the front gable truss 14. The lower portion of the truss is secured by any well known means such as construction nails (not shown) to support frame 18. Since support truss 20 is only attached at its lower portion it will tend to sway or tip if it is not properly balanced. In order to hold the first truss 20 in the erect position, it is attached to lacer strap 12, using a nail or nails (in the example of FIG. 8) at attachment points 24. This process is repeated, attaching the succeeding support trusses 20, seriatim in spaced relationship 24 inches apart until the rear gable truss 16 is reached.

After each support truss is in place and supported by lacer straps 12, roof sheathing 40 is installed directly over the top of lacer strap 12 (FIG. 10). Thus, it is not necessary to remove the lacer straps as is presently required in the conventional use of 1"×3" boards. The roof sheathing in addition to providing protection to persons inside the structure provides the necessary structural support for trusses 20.

It should be understood that in most instances only one strap 12 is necessary for supporting the trusses 20. However, in some cases, it may be necessary to leave support trusses for an extended period of time before the roof sheathing is installed. In such cases, an additional lacer strap 12 can be installed on the opposite side of building structure 10 as disclosed in FIG. 1 to further enhance the support for the trusses 20. Further, in other instances, wind or other conditions may dictate additional support for the trusses when they are being erected, in which event two straps as disclosed in FIG. 1 also may be required. The installation process in the use of two straps 12 would, of course, be like that described above.

Figure 11:
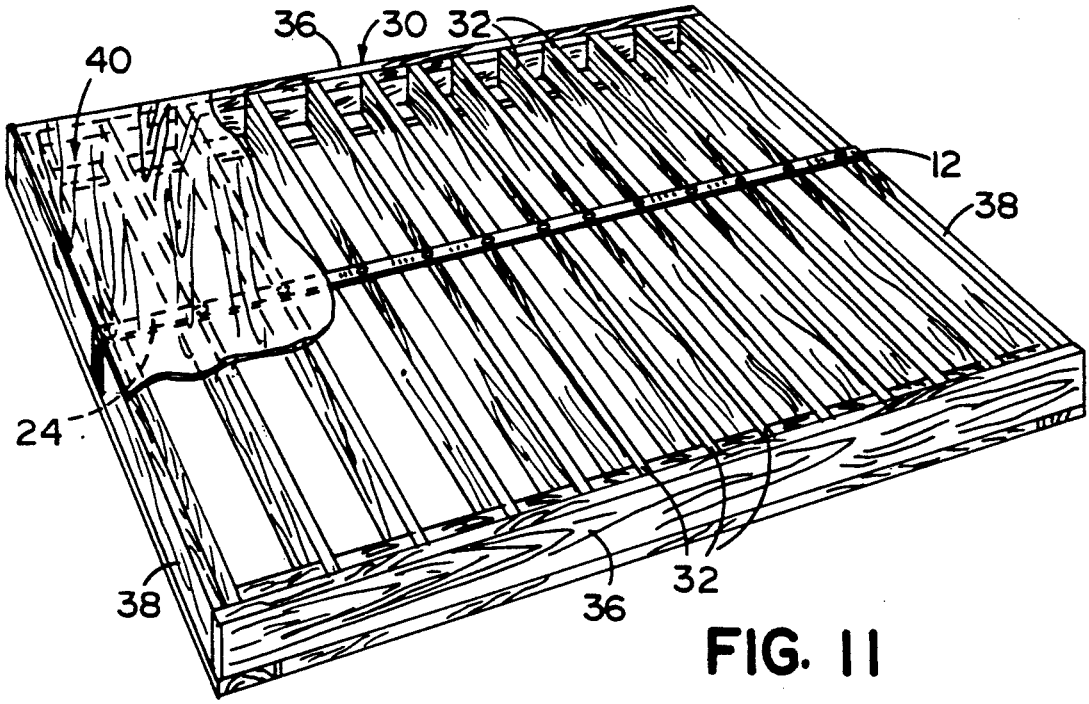
FIG. 11 is a top, perspective view of a floor joist construction with a lacer strap holding the floor joists in straight unbowed position.
Figure 12:
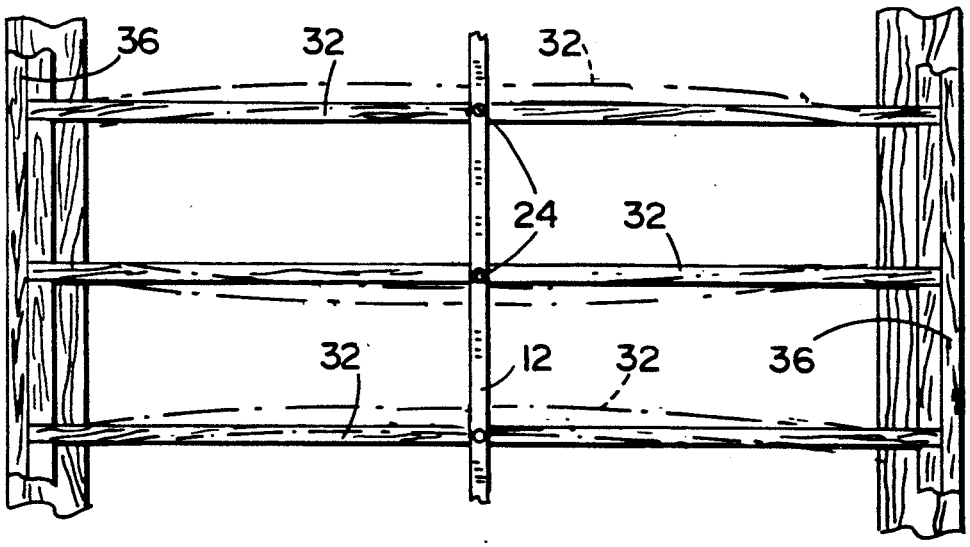
FIG. 12 is an enlarged, partial, top plan view of the lacer strap and its respective attachment points to only a portion of the floor joists of FIG. 9 to illustrate the laser strap function.

FIGS. 11 and 12 illustrate a second embodiment of the invention wherein lacer strap 12 is used in the construction of a floor 30. As shown in FIG. 11, as each joist 32 is laid into position, it is attached to each respective floor frame section 36 at both ends. If joist 32 is of sufficient length and a sufficient force is applied to one or opposite ends of the joist, the joist will have a tendency to whip or bow as depicted in phantom in FIG. 12. In order to prevent this tendency, lacer strap 12 is used and is attached between and to the parallel floor frame sections 38 with the lacer strap 12 running in a direction so that each joist 32 as installed is at a right angle to the strap 12. As each joist 32 is installed, lacer strap 12 is attached thereto to provide a support of sufficient tensile strength so as to prevent the bow of joists 32 which frequently occurs, as illustrated by the phantom lines in FIG. 12. Joists 32, like support trusses 20, are each typically spaced 24 inches apart with lacer strap 12 attaching at each respective attachment point 24. After the lacer strap is in position, flooring can be laid over the top of each joist 32, as well as lacer strap 12. Through the use of laser strap 12, each joist 32 will always remain in a straight or rigid position allowing fixed placement of nails when the flooring is laid.

It should become evident from the above description of my invention that I have provided a greatly simplified apparatus and method for constructing building structures requiring temporary support of spaced construction members. Such method and apparatus establishes and maintains a temporary spacing of said construction members previous to other components being attached thereto for permanently holding the spaced members in properly spaced position.

My apparatus and method is especially adapted for erecting preassembled trusses and holding them in properly spaced position before the sheathing is attached thereto. My invention eliminates the tedious and expensive methods previously used including the securing and subsequent removal of strips of board that were attached to the spaced trusses previous to sheathing being applied. In accordance with this invention, sheathing is mounted directly over the lacer strap 12 eliminating the necessity of removing anything before applying the sheathing. Further, my lacer strap is substantially more easily handled since it does not require a worker to hand up the strips of boards and the marking of the same for securing the trusses in spaced position prior to applying the sheathing. The strap is merely attached to the two end gable trusses so as to extend taut between the two trusses. The markings on the strap 12 provide the exact spacing of the trusses which heretofore has been accomplished by measuring along the long strips of board as previously discussed. Thus, my invention eliminates the cost of the board strips and also is much less time consuming in establishing the placement of the trusses as well as securing them temporarily in spaced position prior to nailing the sheathing directly over the straps onto the trusses.

Although I have disclosed the preferred embodiments of my invention, changes and modifications in the specifically described embodiments can be carried out without departing from the principles of the invention, which is intended to be limited only in the scope of the appended claims, as interpreted according to the principles of patent law including the doctrine of equivalents.

The embodiments of the invention in which an exclusive property or privilege is claimed are defined as follows:

1. A method of constructing a portion of a building including construction members extending in a direction parallel to each other in desired, predetermined, spaced positions, comprising the steps of temporarily holding said members in said positions prior to permanently securing said members in said positions, which includes the steps of:

providing a flexible strap of sufficient tensile strength to sustain forces tending to move said members out of said predetermined, spaced positions when placed in said predetermined positions;

attaching one end of said flexible strap to a first fixed support member and attaching said flexible strap to a second fixed support member with said strap extending in space taught between said first and second support members at a predetermined angle to said direction;

placing said construction members between said support members at said desired predetermined positions; and securing said construction members to said strap at predetermined, spaced points on said strap, said spaced points corresponding to the said desired predetermined, spaced positions.

2. The method of claim 1 in which the said strap is premarked at said predetermined, spaced points and said construction members are preassembled trusses which are seriatim raised to said desired positions and seriatim secured to said strap at selected, marked points to prevent said trusses from tipping.

3. The method of claim 1 in which the strap is premarked at said predetermined, spaced points.

4. A method according to claim 1 further including the step of:

providing an additional strap like that of the said strap; and attaching said additional flexible strap to said first fixed support member and said second fixed support member and securing said construction members to said additional strap to provide additional support for said construction member.

5. A method according to claim 1 wherein said construction members are attached to said strap with a construction nail.

6. The method according to claim 1 wherein an unobstructed hole is provided in said strap at each of said spaced points.

7. The method according to claim 6 wherein a grommet is provided around each of said holes.

8. The method of claim 1 in which a substantially indelible premarking is provided at each of said spaced points.

9. The method according to claim 1 wherein a dimpled indentation is provided at each of said spaced points.

10. The method according to claim 2 wherein said first and second fixed support members are end gable trusses.

11. The method of claim 1 in which said strap is premarked at predetermined, spaced points and said construction members are floor joists secured to said strap intermediate their ends at selected, marked points on said strap to prevent said joists from bowing.

12. The method of claim 1 in which said strap is provided in a coil and a sufficient length of said strap is uncoiled from said coil so as to span the distance and be tightly drawn between said first and second fixed support members.

13. In a method of constructing the roof of a building, said roof including a first fixed roof truss member and a second fixed roof truss member spaced from said first fixed roof truss member;

providing a plurality of intermediate roof truss members located between said first and second fixed truss members in desired, predetermined, spaced positions prior to permanently securing said intermediate truss members in said positions, which includes the steps of:

erecting said first fixed roof truss member and said second fixed roof truss member spaced from said first fixed roof truss member;

providing a flexible strap of sufficient tensile strength to sustain forces tending to move said intermediate truss members out of said predetermined, spaced positions when placed in said predetermined positions;

attaching one end of said flexible strap to said first fixed roof truss member and a second end to said second fixed roof truss member with said strap extending taut between and at a predetermined angle to said first and second fixed roof trusses;

placing and raising said intermediate truss members at said desired predetermined, permanent positions; and securing said truss members to said strap at predetermined, marked, spaced points on said strap, said space joints corresponding to the said desired predetermined, spaced positions of said truss members; and securing paneling directly over said spaced first and second fixed truss members, said intermediate truss members and said strap to permanently hold the support said intermediate roof truss members in said desired predetermined spaced positions.

14. The method of claim 13 in which the said strap is premarked at said predetermined, spaced points and said preassembled intermediate trusses are seriatim raised to said desired positions and seriatim secured to said strap at selected, marked points to prevent said trusses from tipping.

15. The method of claim 13 in which the strap is premarked at said predetermined, spaced points.

16. A method according to claim 13 further including the step of:

providing an additional flexible strap like that of the said strap; and attaching said additional flexible strap to said first fixed truss member and said second truss member with said additional strap being spaced from and at a predetermined angle to said strap already secured to said first and second fixed truss members and securing said intermediate roof truss members to said additional strap to provide additional support for said intermediate roof truss members.

17. The method of claim 13 in which said strap is provided in a coil and a sufficient length of said strap is uncoiled from said coil so as to span the distance and be tightly drawn between said first and second fixed roof truss members.

18. A method of temporarily holding pre-assembled building roof truss members in desired, predetermined, vertical planes prior to permanently securing said truss members in said planes, which includes the steps of:

providing a flexible strap, said strap being of sufficient tensile strength to sustain forces tending to move said truss members out of said predetermined, spaced vertical planes when placed in said predetermined vertical planes;

attaching one end of said flexible strap to a first fixed support member and attaching said flexible strap to a second fixed support member with said strap extending taut in space between and at a predetermined angle to said vertical planes;

providing a plurality of roof truss members;

placing and raising said truss members at said desired, predetermined, permanent positions; and securing said truss members to said strap at predetermined, spaced points on said strap, said spaced points corresponding to the said desired predetermined, spaced, vertical planes.

19. The method of claim 18 in which the said strap is premarked at said predetermined, spaced points and said preassembled intermediate trusses are seriatim raised to said desire positions and seriatim secured to said strap at selected, marked points to prevent said trusses from tipping.

20. A method according to claim 18 further including the steps of:

providing an additional flexible strap like that of the said strap; and attaching said additional flexible strap to said first fixed truss member and said second fixed truss member with said additional strap being spaced from and at a predetermined angle to said strap already secured to said first and second rigid truss members, and securing said intermediate roof truss members to said additional strap to provided additional support for said intermediate roof truss members.

21. The method according to claim 18 wherein said fixed roof truss members are end gable trusses.

22. The method of claim 18 in which said strap is provided in a coil and a sufficient length of said strap is uncoiled from said coil so as to span the distance and be tightly drawn between said first and second fixed roof truss members.

23. In a method of constructing a floor having a plurality of floor joists arranged in desired, predetermined, spaced positions extending in a given direction between first and second spaced and fixed floor frame members comprising the steps of temporarily holding said floor joists in said spaced positions prior to permanently securing said floor joists in said positions, which includes the steps of:

providing a flexible strap, said strap being of sufficient tensile strength to sustain forces tending to bow said floor joists out of said predetermined, spaced positions when placed in said predetermined positions;

attaching one end of said flexible strap to said first fixed frame member and attaching said flexible strap to said second fixed frame member with said strap extending taut and in space between said first and second frame members and at a predetermined angle to said direction;

providing a plurality of floor joists;

placing said floor joists at said desired, predetermined, permanent positions; and securing said floor joists to said strap at predetermined, spaced points on said strap, said spaced points corresponding to the said desired, predetermined, spaced positions.

24. The method of claim 23 in which said strap is provided in a coil and a sufficient length of said strap is uncoiled from said coil so as to span the distance and be tightly drawn between said first and second fixed floor frame members.

* * * * *